US009402140B2

(12) United States Patent
Kim

(10) Patent No.: US 9,402,140 B2
(45) Date of Patent: Jul. 26, 2016

(54) METHOD AND APPARATUS FOR ADJUSTING AIR PRESSURE INSIDE THE EAR OF A PERSON WEARING AN EAR-WEARABLE DEVICE

(71) Applicant: Samsung Electronics Co., Ltd., Gyeonggi-do (KR)

(72) Inventor: Yangwook Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 27 days.

(21) Appl. No.: 14/494,959

(22) Filed: Sep. 24, 2014

(65) Prior Publication Data

US 2015/0092971 A1 Apr. 2, 2015

(30) Foreign Application Priority Data

Oct. 1, 2013 (KR) ..... 10-2013-0117137

(51) Int. Cl.
*H04R 25/00* (2006.01)

(52) U.S. Cl.
CPC ..... *H04R 25/30* (2013.01); *H04R 25/558* (2013.01); *H04R 25/554* (2013.01); *H04R 25/70* (2013.01); *H04R 2225/025* (2013.01); *H04R 2225/61* (2013.01); *H04R 2460/05* (2013.01)

(58) Field of Classification Search
USPC ..... 381/314
See application file for complete search history.

(56) References Cited

U.S. PATENT DOCUMENTS 4,237,905 A * 12/1980 Keller ..... A61B 5/12 600/559
6,004,274 A * 12/1999 Nolan ..... A61B 1/2275 600/481
2008/0144842 A1* 6/2008 Goldstein et al. ..... 381/56
2012/0082335 A1* 4/2012 Duisters et al. ..... 381/375
2013/0195299 A1* 8/2013 Iseberg ..... A61B 5/7203 381/315

FOREIGN PATENT DOCUMENTS

KR 10-1169885 B1 7/2012

* cited by examiner

*Primary Examiner* — Davetta W Goins
*Assistant Examiner* — Amir Etesam
(74) *Attorney, Agent, or Firm* — Cha & Reiter, LLC

(57) ABSTRACT

A method is provided including: receiving a signal for regulating a valve of an ear-wearable device; and changing a state of the valve based on the signal, the changing including at least one of opening and closing the valve.

13 Claims, 8 Drawing Sheets

METHOD AND APPARATUS FOR ADJUSTING AIR PRESSURE INSIDE THE EAR OF A PERSON WEARING AN EAR-WEARABLE DEVICE

CLAIM OF PRIORITY

This application claims priority from and the benefit under 35 U.S.C. §119(a) of Korean Patent Application No. 10-2013-0117137, filed on Oct. 1, 2013, which is hereby incorporated by reference for all purposes as if fully set forth herein.

BACKGROUND

1. Field of the Disclosure

The present disclosure relates to electronic devices and more particularly to a method and apparatus for adjusting the air pressure inside the ear of a person wearing an ear-wearable device.

2. Description of the Prior Art

As the world proceeds to an aging society, patients with age-related diseases tend to increase. One such age-related disease is presbycusis which results in hearing degradation. Most of presbycusis patients use a hearing aid devices to overcome their hearing degradation.

Hearing aid devices may be used by congenital hearing-impaired patients, patients who have hearing impairment due to accidents or other diseases, as well as presbycusis patients. In general, a hearing aid device is an apparatus that is worn on the ear of a patient that amplifies sound according to the patient's hearing abilities. A typical hearing aid device includes a microphone for collecting sound, an amplifier for amplifying the sound, and a speaker or a receiver to output the amplified sound. Digital hearing aid devices may further include a CODEC or D/A and A/D converters, and a processor.

The type of hearing aid used may vary with the kind of hearing impairment of the patient. For example, in-the-canal hearing aids may be used on patients who have a whole frequency hearing impairment or a low-frequency hearing impairment and they may be inserted into the external auditory meatus in the ear. However, when inserted into the external auditory meatus as described above, in-the-canal hearing aids may block the space inside the external auditory meatus, i.e., the space between the tympanic membrane of the year and the hearing aid.

When such blockage takes place, the patient may experience an echo/feedback effect or a closure effect. The echo or feedback effect may be characterized by a condition in which sound amplified by the hearing aid echoes or resonates inside the ear of the patient to cause skull vibration so that low sounds become excessively amplified. In addition, the closure effect may be characterized by a condition in which the patient feels stuffy due to a difference in the air pressure between the interior and exterior of the patient's ear.

In order to prevent echo/feedback and closure effects, hearing aid devices may be provided with a vent hole that prevents the buildup of air pressure (e.g., either positive or negative air pressure) inside the patient's ear. However, in some instances, it may be difficult to outfit hearing aid devices with an appropriately-sized vent hole. One reason for this may be that of inadequate sizing. For example, the size of a given hearing aid device may be too small or large, the size of the external auditory meatus of a given patient may be too small or large, and/or the size of a given vent hole may be too small to permit air inside the patient's ear to be fully discharged. Furthermore, in some instances, vent holes may be unable to prevent the build of excessive air pressure during sudden changes in atmospheric pressure that are experienced when a patient mountain-climbs or performs another similar activity. For this reason, the need exists for new techniques for adaptively varying the size of the vent hole(s) of hearing aid devices, so as to compensate for conditions that cause the build-up of air pressure inside patients' ears.

SUMMARY

According to one aspect of the disclosure, a method is provided comprising: receiving a signal for regulating a valve of an ear-wearable device; and changing a state of the valve based on the signal, the changing including at least one of opening and closing the valve.

According to another aspect of the disclosure, a method is provided comprising: transmitting a first request for a measurement of an air pressure in a space between an ear-wearable device and a tympanic membrane of a wearer of the hearing aid device; receiving the measurement of the air pressure from the hearing aid device; and outputting, by an output device, a first indication of the measurement.

According to another aspect of the disclosure, an ear-wearable device is provided comprising: an air pressure sensor configured to measure air pressure in a space between the hearing aid device and a tympanic membrane of a wearer of the hearing aid device; an air pressure valve configured to adjust the air pressure in the space between the hearing aid device and the tympanic membrane of the wearer of the hearing aid device; and a controller configured to, when a regulation signal is received, open or close the air pressure valve in response to the regulation signal.

According to another aspect of the disclosure, an electronic device is provided comprising a processor configured to: transmit a request for a measurement of an air pressure in a space between an ear-wearable device and a tympanic membrane of a wearer of the hearing aid device; receive the measurement of the air pressure from the hearing aid device; and output, by an output device, an indication of the measurement.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Figure 1:
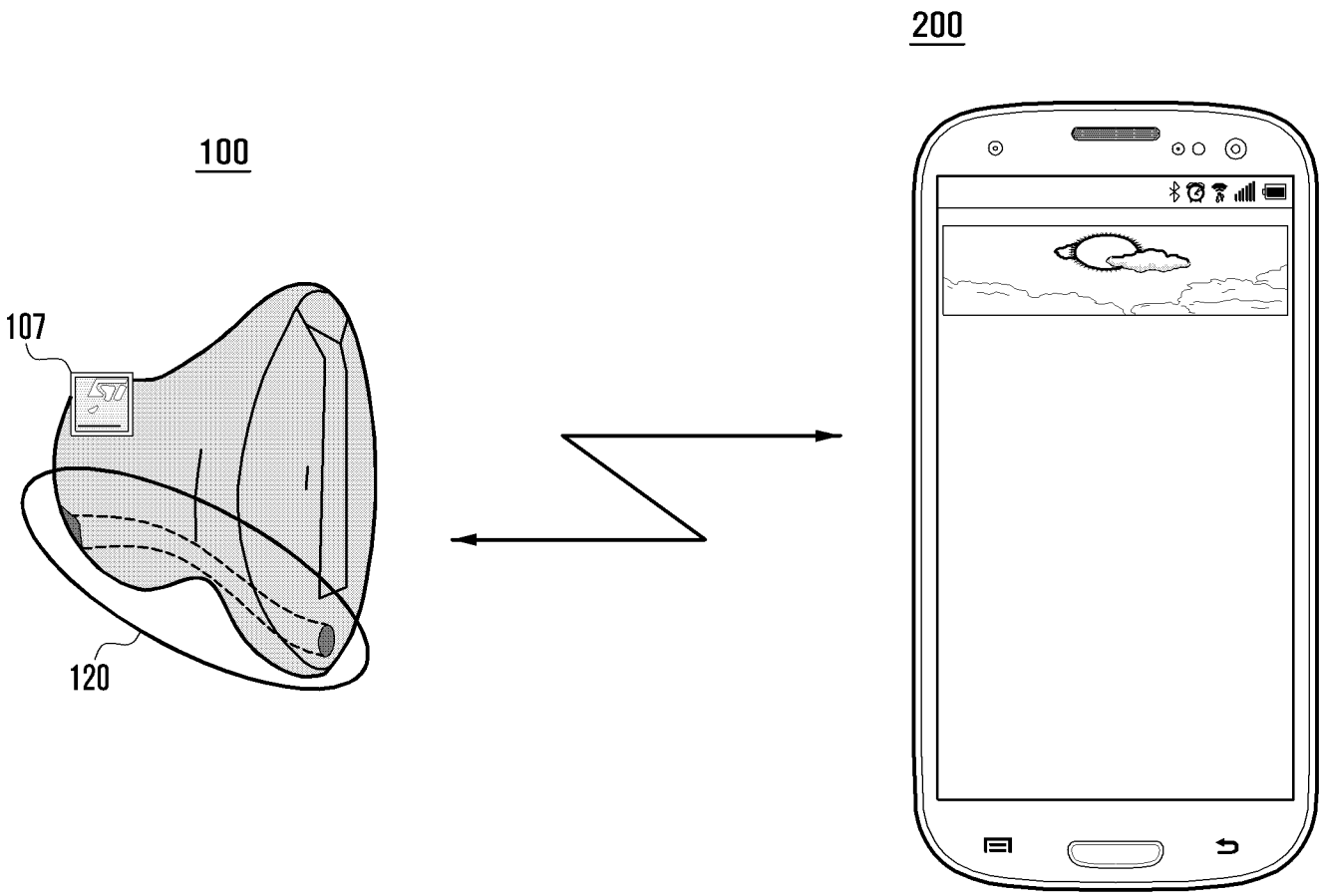
FIG. 1 is a diagram illustrating an example of a system, according to aspects of the disclosure.

Hereinafter, various aspects of the present disclosure will be described with reference to the accompanying drawings.

The accompanying drawings of the present disclosure are provided in order to help understanding the present disclosure, and it should be noted that the present disclosure is not limited to a form, disposition and the like which are exemplified in the accompanying drawings of the present disclosure. Furthermore, equivalents or expansions of additional embodiments for the accompanying drawings should be construed through the descriptions referring to the drawings. In addition, various aspects of the present disclosure may be applied to ear-wearable audio output apparatuses or in-the-canal audio output apparatuses, such as wireless or wired headphones, headsets, earphones, ear-sets, ear-buds, or the like as well as an ear-wearable device. Hereinafter, for ease of explanation, the description will be made with respect to an ear-wearable device.

FIG. 1 is a diagram illustrating an example of a system according to aspects of the disclosure. In this example, the system includes an ear-wearable device 100 and a smart terminal 200. Furthermore, in this example, the hearing aid device 100 and the smart terminal 200 are connected to one another via a wireless connection.

Although in this example, the device 100 is an ear-wearable device, in other examples the device 100 may be another type of ear-wearable device, such as a headphone, a headset, an ear plug, an ear muff, etc. In some aspects, ear-wearable devices may include in-the-ear devices and on-the-ear devices. For the purposes of this disclosure, the term "in-the-ear device" is defined as any device that is worn at least partially in the ear canal of a person, such as, but not limited to, an ear-wearable device, a headphone, an ear plug, or an ear muff, for example. For the purposes of this disclosure, the term "on-the-ear device" is defined as any device that is worn at least partially on the ear of a person, so as to block, at least partially, the free flow of air between the and the person's surrounding environment. Examples of on-the-ear devices may include, without limitation, an ear-wearable device, a headphone, an ear plug, or an ear muff.

The hearing aid device 100 described in FIG. 1 may be any suitable type of hearing aid device, such as an ear-wearable device of which receiver is mounted in the ear as well as in-the-canal hearing aid device. For example, the hearing aid device 100 may include an in-the-canal hearing aid device, such as a Receiver In-the-Canal (RIC) type and a Completely-In-the-Canal (CIC) type, and/or another type of hearing aid devices of which a receiver is mounted in the external auditory meatus of the ear.

Now, referring to the drawing, the hearing aid device 100 may include a subminiature digital air pressure sensor 107 that measures the air pressure inside the ear, i.e., the air pressure between the hearing aid device 100 and the tympanic membrane of the hearing aid device wearer, and have a vent hole 120 through which air inside the ear passes to the outside of the hearing aid device 100. For example, the digital pressure sensor 107 of the hearing aid device 100 may be a digital apparatus for measuring the internal air pressure between the tympanic membrane of the hearing aid device wearer and the hearing aid device, i.e., the air pressure of the external auditory meatus, but it is not limited thereto.

The vent hole 120 of the hearing aid device 100 is configured to have a micro-valve (not shown in FIG. 1). The vent hole may be formed to allow the air to pass therethrough, and the micro-valve may be provided on both the outer side (i.e., the portion of the hearing aid device which is exposed to the atmosphere) where a microphone is positioned and an inner side (i.e., the portion where signals are output from the hearing aid device to the tympanic membrane) where a speaker that outputs an amplified signal is positioned, or the micro-valve may be provided on either the outer side or the inner side. This micro-valve may increase or reduce the air pressure inside the ear according to the method described later, so the difference between the air pressure inside the ear and the atmospheric pressure may be reduced. In some implementations, the size of the micro-valve may be less than 3×3 mm. The state of the valve, such as information on the opening and closing of the valve may be transferred to a micro-processor by the digital micro air pressure valve through surrounding circuits, and the opening and closing of the valve may be controlled by the micro-processor.

The micro-valve may adjust the air pressure inside the ear by regulating the flow of air or liquid through the vent hole without physical adjustment of the size of the vent hole. Specifically, the micro-valve may adjust the degree of the opening and closing of the valve or the air density in the hearing aid device, but it is not limited to a specific method. Hereinafter, for the convenience of explanation, it is given that the air pressure inside the ear is adjusted by the change of the degree of the opening and closing of the micro-valve.

In addition, the hearing aid device 100 may be configured to exchange data with the smart terminal 200 via a wired and/or wireless connection. When the smart terminal 200 requests a state of the micro-valve, the hearing aid device 100 may generate an indication of the degree to which the valve is open (or closed) and provide the same to the smart terminal 200. Further, when a request for regulating the air pressure valve of the hearing aid device 100 is received from the smart terminal 200, the valve may be opened and/or closed in accordance with the request in order to adjust the air pressure inside the ear of the hearing aid device wearer. Furthermore, the hearing aid device 100 may provide air pressure information measured by a digital air pressure sensor 107 of the hearing aid device 100 to the smart terminal 200 spontaneously or by a request of the smart terminal 200. The measured air pressure information may be displayed in the smart terminal 200 in real-time and refreshed periodically. Accordingly, in some aspects, the air pressure inside the ear of the wearer of the hearing aid device 100 may be adjusted based on one or more of: information pre-stored in the hearing aid device 100, information stored on the smart terminal 200, and/or the measured air pressure information. Further, when the adjustment of the air pressure is not successful after the valve is opened or closed further, the wearer may check whether he or she properly wears the hearing aid device.

In operation, the smart terminal 200 may receive information on the opening and closing of the micro-valve of the hearing aid device 100. In addition, the smart terminal 200 may output the received information (e.g., graphically, audibly, etc.) For example, the smart terminal 200 may provide the same in the form of at least one of various visual displaying means, such as a graph, an image, a number, and an emoticon, to the user. Furthermore, the smart terminal 200 may control the opening and closing of the micro-valve in the hearing aid device 100 in response to a user's request. Also, the smart terminal 200 may display an indication of a change of the air pressure inside the ear which is measured by the digital air pressure sensor in the form of at least one of various visual displaying means, such as a graph, an image, a number, and an emoticon.

The configuration and the operation of the hearing aid device 100 and the smart terminal 200 will be described in more detail with reference to the following drawings.

FIG. 1 shows the smart terminal 200 that is a terminal for controlling the hearing aid device 100. For example, the smart terminal may include any suitable type of electronic device, such as a mobile phone, smartphone, notebook PC, and computer which includes a controller, a communication unit, an input unit, a display unit, and a memory, or the like. For example, and without limitation, the term "electronic device" may include a desktop Personal Computer (PC), a laptop PC, a Personal Digital Assistant (PDA), a Portable Multimedia Player (PMP), a tablet PC, a mobile phone, a video phone, a feature phone, a smartphone, an electronic book reader, a digital camera, a wearable device, a wireless device, a Global Positioning System (GPS) system, a hand-held device, an MP3 player, a camcorder, a game console, an electronic watch, a flat panel device, an electronic photograph, an electronic board, an electronic sign board, a projector, a navigation device, a black box, a set-top box, an electronic dictionary, a refrigerator, an air conditioner, a vacuum cleaner, an artificial intelligence robot, a TeleVision (TV), Digital Versatile Disk (DVD) player, a stereo, an oven, a microwave oven, a washing machine, an air cleaner, a medical device, a vehicle device, a shipbuilding device, an aircraft device, a security device, agricultural, livestock, and fishery equipment, electronic clothing, an electronic key, an electronic bracelet, or an electronic necklace. For example, the electronic devices may be driven by various operating systems, such as Android, iOS, Windows, Linux, Symbian, Tizen, and Bada. The disclosure is not limited to any particular type of operating system and/or electronic device.

Figure 2:
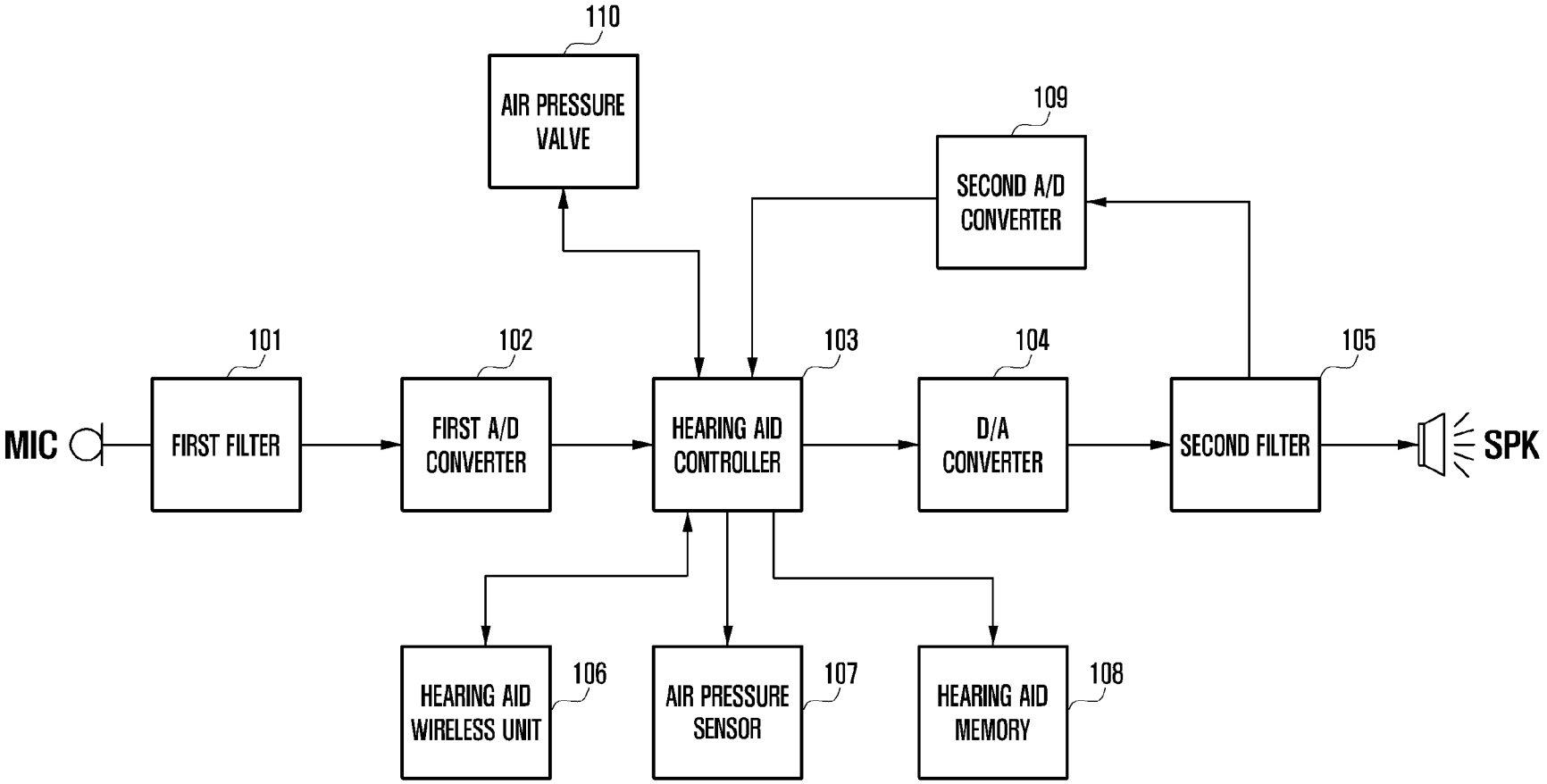
FIG. 2 is a diagram illustrating an example of an ear-wearable device, according to aspects of the disclosure.

FIG. 2 is a diagram illustrating an example of an ear-wearable device according to aspects of the disclosure. Although FIG. 2 shows a digital hearing aid device, in some implementations an analog hearing aid device may be used instead. The hearing aid device of FIG. 2 includes elements for amplifying sound, which is an intrinsic function of the hearing aid device, and elements for controlling the change of the air pressure inside the ear of the hearing aid device wearer.

According to aspects of the disclosure, the hearing aid device may include a microphone MIC, the first filter 101, the first analog-to-digital converter 102, a hearing aid controller 103, a digital-to-analog converter 104, the second filter 105, a speaker SPK, and the second analog-to-digital converter 109. The controller 103 may include any suitable type of processing circuitry, such as a processor, a Field-Programmable Gate Array (FPGA), and an Application-Specific Integrated Circuit (ASIC), for example According to various aspects of the present disclosure, the hearing aid device may further include a, a hearing aid wireless unit 106, an air pressure sensor 107, and an air pressure valve 110. Additionally or alternatively, the hearing aid device may further include a hearing aid memory 108 and an alarm display unit. In some implementations, one or more of the first filter 101, the second filter 105 and the second analog-to-digital converter 109 may be omitted.

Now, the basic operations of the hearing aid device and the operations for identifying the state of the hearing aid device and the state of the hearing aid device wearer according to various aspects of the present disclosure will be described.

In operation, the microphone MIC may receive an acoustic signal. The microphone may receive the acoustic signal in the range of audible frequencies or predetermined frequencies, and convert the acoustic signal to an electrical audio signal to be thereby output. Accordingly, the signal output from the microphone is an electrical analog audio signal. The electrical analog audio signal output from the microphone is input to the first filter 101. The first filter 101 filters the input signals according to the hearing aid device wearer's hearing feature or extracts signals in the range of audible frequencies from the input signals. In addition, the first filter 101 may perform anti-aliasing.

The analog signal filtered by and output from the first filter 101 is input to the first analog-to-digital converter 102 to be thereby converted to digital data according to a predetermined method. The digital data output from the first analog-to-digital converter 102 is input to the hearing aid controller 103. According to the type of hearing aid device, the signal from the microphone may be directly input to the first analog-to-digital converter 102, and the digital data output from the first analog-to-digital converter 102 may be input to the first filter 101. Alternatively, the first filter 101 may be omitted.

The hearing aid controller 103 may perform one or more of four control operations as follows. The first control operation includes controlling the amplification of the received digital data, which is a basic control operation of the hearing aid device. In performing the first control operation, the hearing aid controller 103 controls to amplify the received digital data by an amplifying ratio configured with respect to the predetermined each frequency band or channel and output the same. A hardware amplifier may be separately provided in the hearing aid device, depending on the type of hearing aid device, or the hearing aid 103 may control the speaker to amplify the digital data by software and output the same. The amplifying ratio configured to each frequency band or channel is predetermined according to the hearing aid device wearer's hearing state, and in general it may be adjusted at the hospitals or the hearing aid device shops.

The second control operation of the hearing aid controller 103 is informing of the change of the air pressure inside the ear. That is, the hearing aid controller 103 controls the digital air pressure sensor to measure the air pressure between the tympanic membrane of the hearing aid device wearer and the hearing aid device. If the change in the air pressure exceeds a predetermined range, the hearing aid controller 103 generates an indication of the air pressure exceeding the predetermined range, and then the hearing aid controller 103 controls the hearing aid wireless unit 106 to transfer the created air pressure information to the smart terminal 200. If the terminal 200 is not connected with the hearing aid device, the hearing aid device may output an audible or visual alarm. Accordingly, the hearing aid device 100 may actively inform the hearing aid device wearer of a sudden change of the air pressure inside the ear.

The third control operation of the hearing aid controller 103 is respond to queries by the smart terminal 200. For example, the third control operation may include providing information on the air pressure between the tympanic membrane of the hearing aid device wearer and the hearing aid device, and the degree of the opening and closing of the digital micro-valve to the smart terminal 200 by a request of the smart terminal 200. That is, when an instruction, such as a request for measuring the air pressure between the tympanic membrane of the hearing aid device wearer and the hearing aid device, is received from the smart terminal 200 through the hearing aid wireless unit 106, the hearing aid controller 103 receives air pressure information measured by the air pressure sensor 107 and converts the received air pressure information to data to be thereby transmitted to the smart terminal 200 through the hearing aid wireless unit 106. According to the above operation, the hearing aid device wearer may obtain the information on the air pressure between the hearing aid device and the tympanic membrane of the hearing aid device wearer through the smart terminal 200 when he or she wishes.

The fourth control operation of the hearing aid controller 103 is controlling the air pressure valve 110. In the case of receiving a control signal for controlling the air pressure valve 110 from the smart terminal 200 through the hearing aid wireless unit 106, the hearing aid controller 103 may open and/or close the air pressure valve 110 as specified by the control signal. Additionally, when an input unit (buttons, a touch, a wheel, a motion sensor, or the like) for controlling the air pressure valve is provided on the hearing aid device, the hearing aid device may control the air pressure valve 110 by itself. Accordingly, the hearing aid controller 103 may control the air pressure valve 110 to thereby adjust the air pressure inside the ear.

The digital-to-analog converter 104 converts digital data amplified by the hearing aid controller 103 to an analog audio signal. The converted analog audio signal is an electrical audio signal that is amplified to a level suitable for the wearer's hearing.

The second filter 105 receives the amplified electrical audio signal and eliminates noises that have been generated during the amplifying operation, the analog-to-digital converting operation and the digital-to-analog converting operation, to thereby output the same. The electrical signal of which noises are eliminated by the second filter 105 may be output in an audio signal to be provided to the hearing aid device wearer through the speaker SPK. In some cases, the signal from the digital-to-analog converter 104 may be directly output in the audio signal through the speaker SPK without the second filter. In addition, some of the electrical audio signals from the second filter 105 may be input to the second analog-to-digital converter 109.

The second analog-to-digital converter 109 converts the signal output from the second filter 105 to digital data and provides the same to the hearing aid controller 103. The hearing aid controller 103 may verify whether the signal is amplified by a desired amplifying ratio by using the signal received from the second analog-to-digital converter 109. The hearing aid device 100 may not include the second analog-to-digital converter 109 in some cases.

The hearing aid wireless unit 106 is a module to allow the hearing aid device to conduct wireless communications with other electronic apparatuses according to a predetermined method. For example, the hearing aid wireless unit 106 may conduct wireless communications on the basis of Bluetooth or Wi-Fi, and/or any other suitable communication protocol. In some implementations, the wireless unit 106 may conduct wireless communications only with electronic devices that have been pre-registered by the user. In addition, the hearing aid device of FIG. 2 is shown to have the hearing aid wireless unit 106. However, when the hearing aid device is connected with the smart terminal 200 by cables, the hearing aid wireless unit 106 may be replaced with an interface device based on a wired communication method. For example, the interface device may be based on various wired communication methods, such as a USB communication method or a wired communication method adopted by the manufacturer of the smart terminal 200.

The air pressure sensor 107 is a digital sensor for measuring the air pressure between the tympanic membrane in the ear of the hearing aid device wearer and the hearing aid device inserted into the ear. The air pressure sensor 107 measures the air pressure between the tympanic membrane and the hearing aid device continuously or by a request of the hearing aid controller 103, and provides the measured result to the hearing aid controller 103. If necessary, a plurality of air pressure sensors may be mounted in the hearing aid device, and the air pressure sensors may measure one or more of the air pressure of other portions inside the ear, the atmospheric pressure, and the air pressure between the tympanic membrane and the hearing aid device, i.e., the air pressure of the external auditory meatus, according to a mounted position or structure.

The hearing aid memory 108 may be configured with a subminiature memory for storing control data required for the control of the hearing aid controller 103 and various setup values for configuring the hearing aid device, such as an adjustment value of the air pressure valve 110 and the amplifying ratio predetermined according to each frequency or channel for amplification. Furthermore, the hearing aid device memory may include a space for storing additional data.

The air pressure valve 110 may be a digital micro fluid valve and configured with an oil pressure type micro air pressure valve for regulating an air flow through the vent hole of the hearing aid device 100. The micro air pressure valve may be controlled by the hearing aid controller 103 to adjust the degree of the opening and closing of the valve, the air density in the hearing aid device, or the pressure of the oil pressure type micro-valve, but it is not limited thereto. The state of the valve such as information on the opening and closing of the valve may be transferred to a micro-processor by the digital micro air pressure valve through surrounding circuits, and the opening and closing of the valve may be controlled by the micro-processor. At this time, the hearing aid controller 103 may adjust the valve(s) on either the tympanic membrane side or the opposite side, or on both sides.

Figure 3:
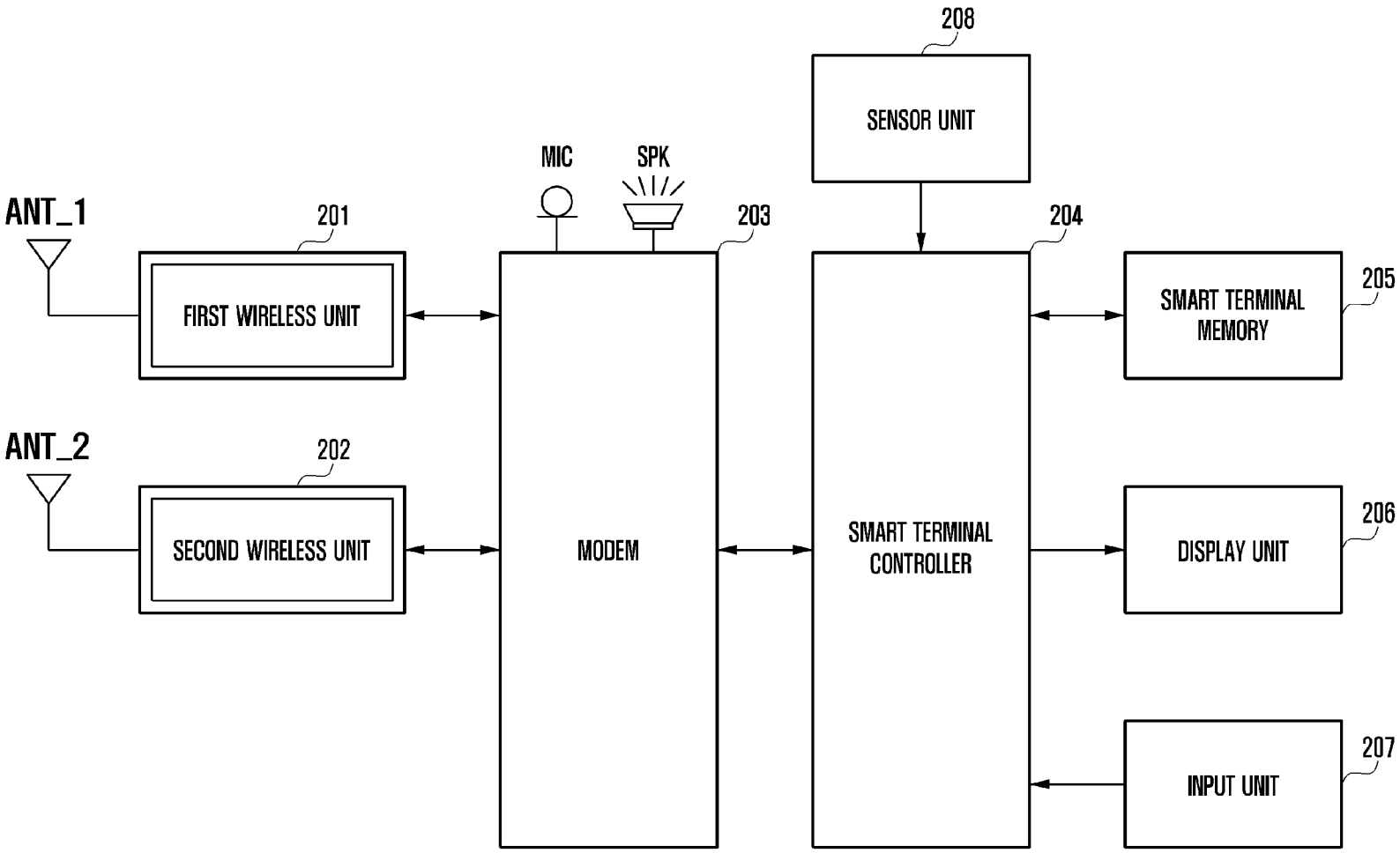
FIG. 3 is a diagram of an example smart terminal, according to aspects of the disclosure.

FIG. 3 is a diagram of an example smart terminal according to aspects of the present disclosure.

The smart terminal 200 includes the first antenna ANT_1 for communication with mobile communication networks and a second antenna ANT_2 for communication with the hearing aid device. Each of the antennas ANT_1 and ANT_2 may be connected with the first wireless unit 201 and the second wireless unit 202, respectively, to provide paths of transmission and reception of data.

The first wireless unit 201 is a processing unit of wireless signals for communication with a specific wireless network such as a mobile network. The first wireless unit 201 transforms the data to be transmitted for voice communication or/and data communication into a high-frequency band according to the corresponding band of the network and transforms signals received from the corresponding network into a low-frequency band. That is, the first wireless unit 201 transforms basebands signal into a high-frequency band corresponding to the network band for voice or data transmission and transmits the same to the corresponding network through the first antenna ANT_1. Also, the first wireless unit 201 receives wireless signals from the corresponding network through the first antenna ANT_1 and transforms the received signals into the baseband signals. The operation of the first wireless unit 201 may vary with mobile networks to which the smart terminal 200 belongs.

The second wireless unit 202 transforms baseband signals into a high-frequency band corresponding to a predetermined wireless band for data transmission and transmits the same through the second antenna ANT_2. Also, the second wireless unit 202 receives wireless signals from a predetermined wireless band through the second antenna ANT_2 and transforms the received signals into the baseband signals. The operation of the second wireless unit 202 is not limited to the above-described protocol, and it may vary with communication methods with the hearing aid wireless unit 106.

The modem 203 performs data processing, such as modulating, demodulating, encoding and decoding the transmitted and received data. In the case of the normal smart terminal shown in FIG. 3, the modem 203 may include a vocoder for modulating, demodulating, encoding and decoding voice signals. The modem 203 converts an electrical voice signal received from the microphone to a digital voice signal. In addition, the modem 203 may convert the digital voice signal to the electrical analog voice signal and output the same through the speaker SPK. Further, the modem 203 processes the operations of modulating, demodulating, encoding and decoding other data by the control of the smart terminal controller 204.

The smart terminal controller 204 controls overall operations of the smart terminal, and particularly controls to adjust the air pressure between the hearing aid device and the tympanic membrane of the hearing aid device wearer according to various aspects of the present disclosure. The above control may be achieved by regulating the air pressure valve of the vent hole 120 in the hearing aid device 100 as described above, or by other methods. Hereinafter, for the convenience of explanation, the example in which the air pressure is adjusted by regulating the air pressure valve of the vent hole 120 in the hearing aid device 100.

In order to adjust the air pressure between the hearing aid device and the tympanic membrane of the hearing aid device wearer, the smart terminal controller 204 may control the air pressure valve of the vent hole 120 by using a pre-stored hearing aid device control program and receive information on the air pressure between the hearing aid device and the tympanic membrane of the hearing aid device wearer to be thereby provided to the user. In doing so, the smart terminal controller 204 may create an instruction for obtaining the air pressure information from the hearing aid device and provide the instruction to the hearing aid device 100. In addition, the smart terminal 204 may control the air pressure valve of the vent hole 120 by using data received from the hearing aid device. The smart terminal memory 205 may be a storage medium, such as a ROM or/and a RAM, to store various pieces of control data required for the operation of the smart terminal. Also, the smart terminal memory 205 may store control data for communication with the hearing aid device 100 and control data for controlling the air pressure valve of the vent hole 120 in the hearing aid device. Further, the smart terminal memory 205 may store air pressure information required to maintain the air pressure between the hearing aid device and the tympanic membrane and user data.

The display unit 206 may be configured with an LCD panel or an LED panel to display the state of the smart terminal during the operation of the smart terminal and in a stand-by mode under the control of the smart terminal controller 204. Furthermore, the smart terminal 200 may additionally include various output devices, such as a vibration motor (not shown in FIG. 3), an alert generator (not shown in FIG. 3), or a fragrance generator (not shown in FIG. 3), for informing the user. In addition, the modem 203 and the speaker SPK may be used for the alert sound.

The input unit 207 may be comprised of a touch detection sensor for detecting a user's touch or/and key buttons for a key input or/and a hovering sensor. The input unit 207 receives a user's touch input signal or/and a key input signal or/and a hovering signal and provides the same to the smart terminal controller 204.

The sensor unit 208 may include a sensor that measures the atmospheric pressure at the position of the smart terminal 200 to provide atmospheric pressure information. The sensor unit 208 may further include various sensors, such as a GPS, an altitude sensor, a gyro-sensor, and the like as well as the air pressure sensor for measuring the atmospheric pressure. In addition, the atmospheric pressure information, which corresponds to the information on the atmospheric pressure at the position according to the GPS or the altitude sensor, may be received from the outside through the first wireless unit.

Figure 4:
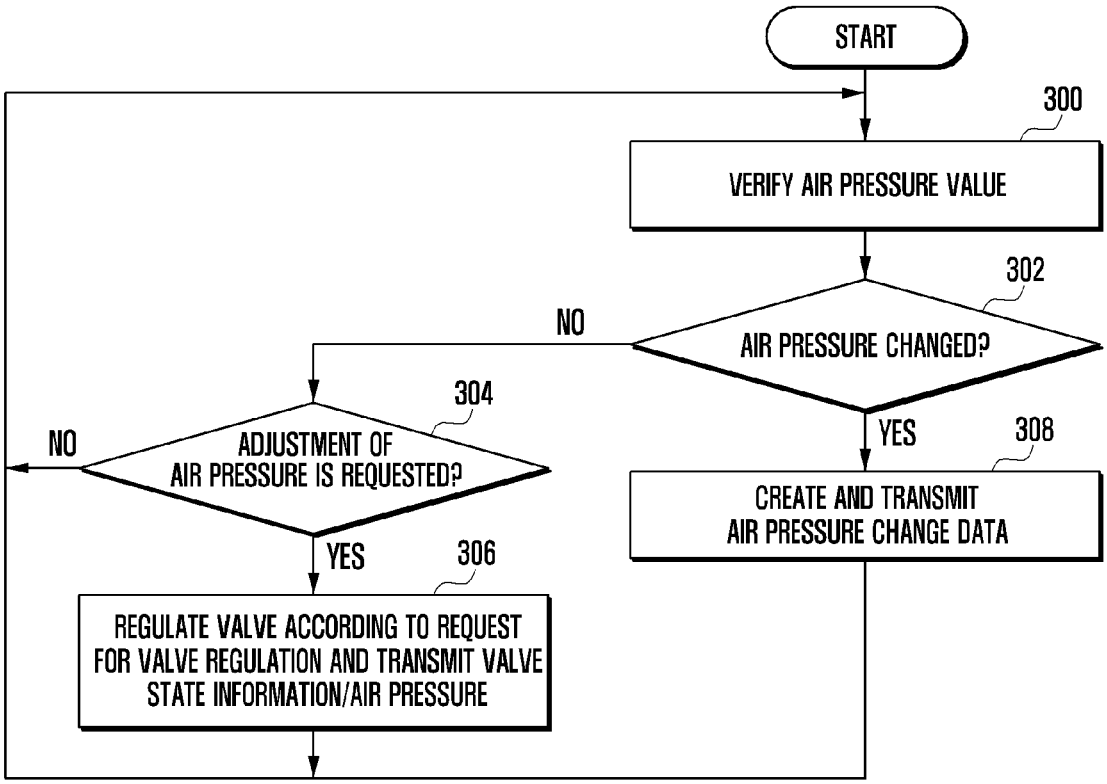
FIG. 4 is a flowchart of an example of a process, according to aspects of the disclosure.

FIG. 4 is a flowchart of an example of a process, according to aspects of the disclosure.

In operation 300, the hearing aid controller 103 continuously verifies the air pressure value received from the air pressure sensor 107. For example, the air pressure sensor 107 may measure the air pressure between the hearing aid device 100 and the tympanic membrane of the hearing aid device wearer in real time or at a predetermined time interval, and provide the measured air pressure value to the hearing aid controller 103. The hearing aid controller 103 receives the air pressure value received from the air pressure sensor 107 and verifies whether the received air pressure value is identical to the air pressure value pre-stored in the hearing aid memory 108 or the received air pressure value is in the predetermined range of the air pressure. The predetermined air pressure value or the predetermined range of the air pressure may be the values which are configured according to the wearer's hearing when making the hearing aid device 100 fit in the ear of the hearing aid device wearer. Additionally or alternatively, the predetermined air pressure value or the predetermined range of the air pressure may be the air pressure value measured a predetermined time ago, e.g., five minutes ago, or the range of the air pressure accumulated for a predetermined time, e.g., five minutes before the time when the current air pressure value is received from the air pressure sensor 107. In operation 302, the hearing aid controller 103 verifies whether the air pressure has been changed by checking whether the air pressure is identical to the predetermined value or is in the predetermined range of the air pressure. When the air pressure is different from the predetermined air pressure value, or the air pressure exceeds the predetermined range of the air pressure, it is determined that the air pressure has been changed. As a result of the checking in operation 302, if the air pressure has been changed, the hearing aid controller 103 proceeds to operation 308. On the other hand, if the air pressure has not changed, the hearing aid controller 103 proceeds to operation 304.

First, proceeding to operation 308 due to the change of the air pressure, the hearing aid controller 103 creates changed air pressure information in the form of data to be transmitted to the smart terminal 200. At this time, the created data to be transmitted to the smart terminal 200 may be air pressure change data. The air pressure change data may include an indication of an air pressure value and/or a range of the air pressure value. Additionally or alternatively, the air pressure change data may indicate only the measured current air pressure level. Additionally or alternatively, the air pressure change data to be transmitted to the smart terminal 200 may indicate the degree of the increase or decrease in the air pressure relative to a past level of the air pressure.

As described above, when the air pressure change data to be transmitted to the smart terminal 200 is created, the hearing aid controller 103 controls the hearing aid wireless unit 106 to transmit the air pressure change data to the smart terminal 200. Accordingly, the smart terminal 200 may obtain the change data of the air pressure between the hearing aid device and the tympanic membrane.

If the air pressure has not changed, the process proceeds from operation 302 to operation 304. In this case, the hearing aid controller 103 verifies whether the air pressure is requested to be adjusted. In the verification of the request for the air pressure adjustment, it is checked whether a signal of the request for the air pressure adjustment transmitted by the smart terminal 200 is received by the hearing aid wireless unit 106 to be thereby provided to the hearing aid controller 103.

Meanwhile, although not shown in the drawing, operation 304 may be directly performed regardless of operation 302, i.e., regardless of the change of the air pressure. Alternatively, if the air pressure has been changed, operation 304 may be performed after transmitting the air pressure change data to the smart terminal 200.

In some implementations, the air pressure adjustment request may be a request for opening and/or closing the pressure valve 110 on either or both sides of the vent hole 120 in the hearing aid device 100, as set forth above. For example, the regulation of the oil pressure type micro-valve may have the same effect as enlargement or reduction of the size of the vent hole 120. Accordingly, the air pressure between the hearing aid device 100 and the tympanic membrane of the hearing aid device wearer may be adjusted by regulating the amount of the air flow.

When the air pressure is requested to be changed as a result of the verification in operation 304, the hearing aid controller 103 proceeds to operation 306. Otherwise, the hearing aid controller 103 proceeds to operation 300. Proceeding to operation 306 with the request for the air pressure adjustment, the hearing aid controller 103 adjusts the degree of the opening and closing of the air pressure valve 110 according to the request for the air pressure adjustment. This gives the same effect as if the size of the vent hole 120 in the hearing aid device is enlarged or reduced, so that the air pressure between the hearing aid device 100 and the tympanic membrane of the hearing aid device wearer may be adjusted. As described above, the air pressure adjustment may be achieved by adjusting the air density of the digital micro air pressure valve as well as adjusting the degree of the opening and closing thereof, and it is not limited to a specific method.

Afterward, the hearing aid controller 103 may verify the change of the air pressure between the hearing aid device 100 and the tympanic membrane of the hearing aid device wearer for a predetermined time by using the air pressure value provided from the air pressure sensor 107. The hearing aid controller 103 verifies the change of the air pressure for a predetermined time and controls the hearing aid wireless unit 106 to transmit the changed air pressure information to the smart terminal 200. The smart terminal 200 may obtain the information on the change of the air pressure between the hearing aid device 100 and the tympanic membrane of the hearing aid device wearer for the predetermined time after regulating the air pressure valve 110 according to the above process.

Although FIG. 4 shows the data is transmitted and received between the hearing aid device 100 and the smart terminal 200 by wireless communication, it is obvious for those skilled in the art that FIG. 4 may be applied to wired communication as well.

Figure 5:
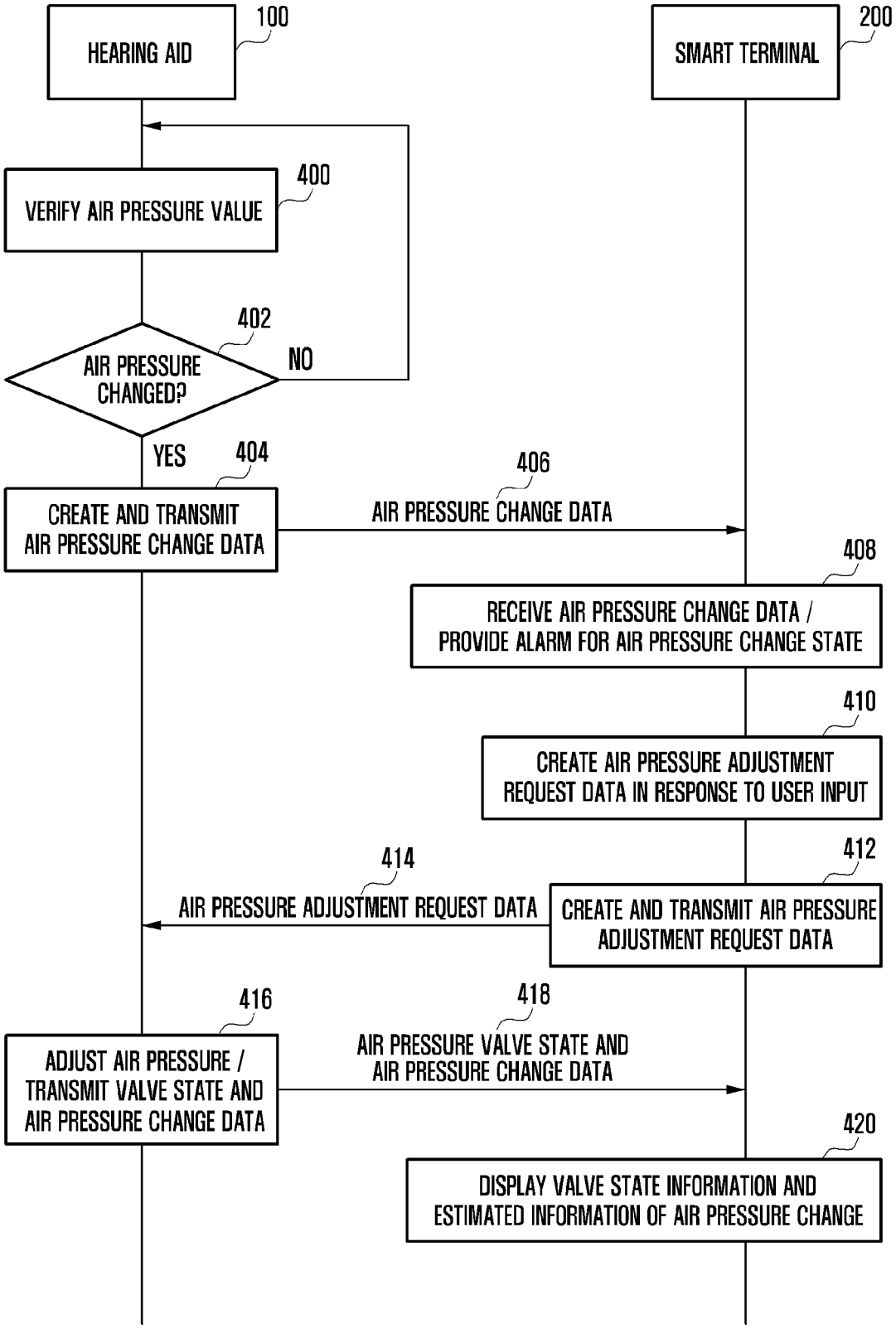
FIG. 5 is a flowchart of an example of a process, according to aspects of the disclosure.

FIG. 5 is a flowchart of an example of a process, according to aspects of the disclosure.

In the example of FIG. 5, the hearing aid device 100 detects the change of the air pressure between the hearing aid device 100 and the tympanic membrane of the hearing aid device wearer and informs the smart terminal 200 of the change of the air pressure. The change in the air pressure may be detected periodically, sporadically. Furthermore, in some implementations the change in the air pressure may be detected autonomously (e.g., without receiving an instruction from the smart terminal 200 beforehand). That is, the smart terminal 200 generates an alarm when air pressure change data is received from the pre-registered hearing aid device 100. Accordingly, if the air pressure between the hearing aid device 100 and the tympanic membrane of the hearing aid device wearer is changed, the hearing aid device wearer may recognize the change of the air pressure between the hearing aid device 100 and the tympanic membrane without manipulating the smart terminal 200. In addition, the hearing aid device wearer may regulate the air pressure valve 110 by using the smart terminal 200 so that the air pressure between the hearing aid device 100 and the tympanic membrane of the hearing aid device wearer remains proper.

In operation 400, the hearing aid controller 103 obtains a measurement of the air pressure in the space between the hearing aid device 100 and the tympanic membrane of the hearing aid device wearer.

In operation 402, the controller 103 detects whether the air pressure has changed. For example, the air pressure may be considered to have changed when the currently-measured value air pressure exceeds a previously-measured value of the air pressure by more than a threshold amount. Additionally or alternatively, the air pressure may be considered to have changed when the currently-measured value of the air pressure falls within a predetermined range. If it is determined that the air pressure has changed, the controller 103 proceeds to operation 404. Otherwise, the controller 103 repeats operation 400.

At operation 404 due to the change of the air pressure, the hearing aid controller 103 creates air pressure change data and controls the hearing aid wireless unit 106 to transmit the air pressure change data to the pre-registered smart terminal 200. The air pressure change data is transmitted to the smart terminal 200 in operation 406. For example, the air pressure change data may be transmitted from the hearing aid device 100 to the smart terminal 200 through various wireless communication methods, such as Bluetooth or Wi-Fi. Alternatively, the wired communication method may be used as well. Hereinafter, for the convenience of explanation, the description will be made on the assumption that the data transmission/reception is performed wirelessly.

In operation 408, the smart terminal 200 may receive the air pressure change data transmitted in operation 406. For example, the smart terminal controller 204 may receive the air pressure change data through the second wireless unit 202 and the modem 203. The smart terminal controller 204 may then output the received air pressure change data to inform the wearer of the change of the air pressure. In addition, the smart terminal controller 204 may inform the user of the change of the air pressure between the hearing aid device 100 and the tympanic membrane through a predetermined alarm. Here, the alarm may be made by using at least one of a vibration, a sound, light-blinking, tactile means, audible means, visual means, olfactory means such as a smell, or the like. In the case of informing the hearing aid device wearer of the occurrence of the change of the air pressure between the hearing aid device 100 and the tympanic membrane, it is preferable to provide another alarm, such as the vibration or the light-blinking as well, because the hearing aid device wearer may not be able to hear the alarm sound.

In addition, in the case of the smart terminal 200 having a sensor for measuring the atmospheric pressure, the current atmospheric pressure information may be provided as well. For example, if the smart terminal sensor unit 208 has a sensor for measuring the atmospheric pressure, the smart terminal controller 204 may obtain the atmospheric pressure measured by the sensor unit 208 and control the display unit 206 to display the same. Further, when the hearing aid device 100 further includes a sensor for measuring the atmospheric pressure, the smart terminal 200 may receive the atmospheric pressure value measured by the hearing aid device 100. Furthermore, if the hearing aid device 100 or the smart terminal 200 does not include a sensor for measuring the atmospheric pressure or the atmospheric pressure is not available, the current atmospheric pressure information may be received from an external server through networks such as the Internet.

Figure 7:
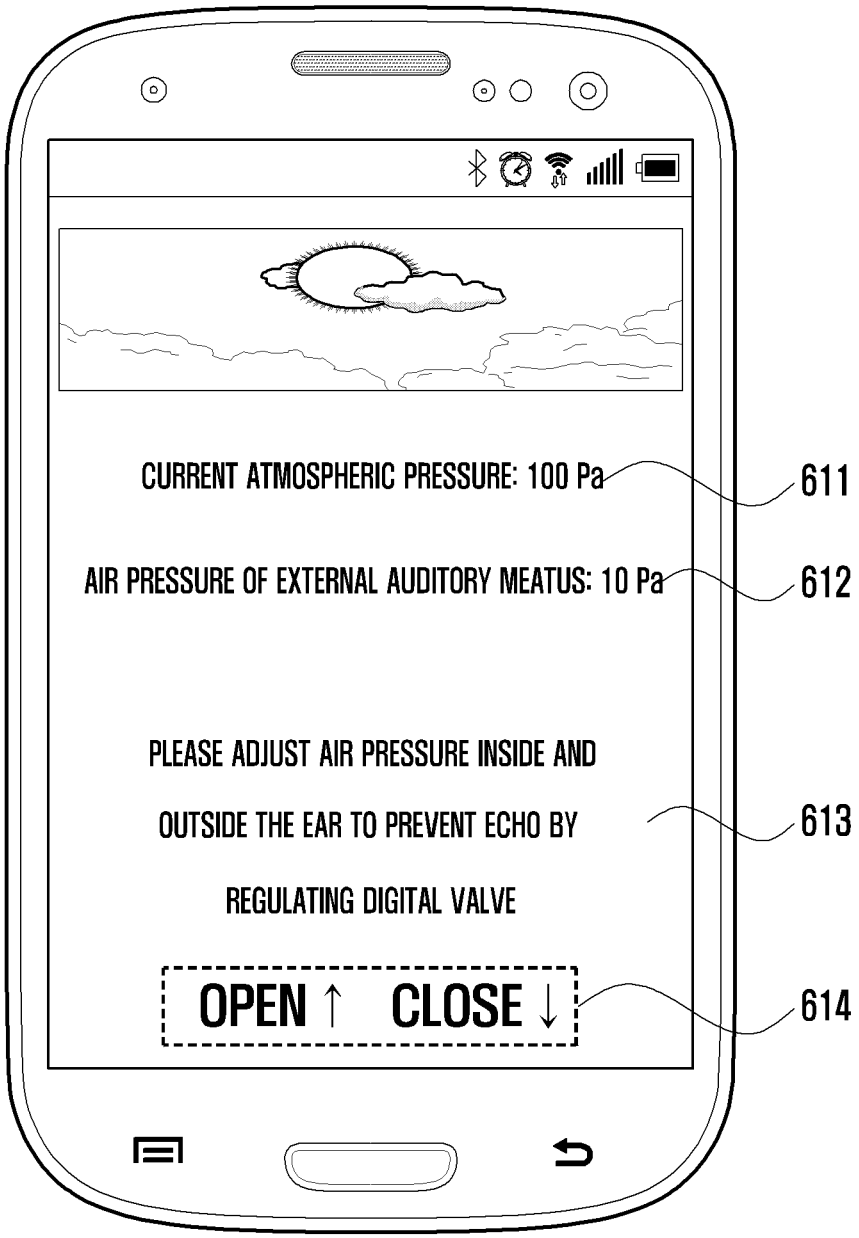
FIG. 7 is a diagram of an example of a user interface, according to aspects of the disclosure.

More detailed description will follow with reference to FIG. 7 illustrating an example of displaying information on the air pressure between an ear-wearable device and the tympanic membrane of the hearing aid device wearer and the atmospheric pressure information in a smart terminal according to an embodiment of the present disclosure.

The smart terminal controller 204 may display the atmospheric pressure value that is provided from the sensor unit 208 or the external server as shown by the reference numeral 611, and at the same time, display the air pressure value, e.g., the information on the air pressure between the hearing aid device 100 and the tympanic membrane of the hearing aid device wearer, received from the hearing aid device 100 as shown by the reference numeral 612. In addition, if the smart terminal 200 stores information on the proper air pressure between the hearing aid device 100 and the tympanic membrane of the hearing aid device wearer, the proper air pressure value may be displayed as well. Further, if the smart terminal memory 205 stores data for instruction to adjust the air pressure between the hearing aid device 100 and the tympanic membrane of the hearing aid device wearer according to the air pressure between the hearing aid device 100 and the tympanic membrane of the hearing aid device wearer, the smart terminal controller 204 may control to retrieve the data for instruction to adjust the air pressure between the hearing aid device 100 and the tympanic membrane of the hearing aid device wearer from the smart terminal memory 205 and display the same on the display unit 206. If the air pressure adjustment data is not stored, the smart terminal controller 204 may control to retrieve a general guide message stored in the smart terminal memory 205 and display the same on the display unit 206 as shown by the reference numeral 613. Further, the controller 204 may control the display unit 206 to display a control image 614 for regulating the digital air pressure valve 110. Hereinafter, the control image 614 will be referred to as an air pressure adjustment window.

"OPEN" shown in the air pressure adjustment window 614 may be aimed at obtaining the effect that the size of the vent hole 120 through the hearing aid device 100 is enlarged by regulating the air pressure valve 110 of the hearing aid device 100, and "CLOSE" may be aimed at obtaining the effect that the size of the vent hole 120 through the hearing aid device 100 is reduced by regulating the air pressure valve 110 of the hearing aid device 100, or vice versa.

In operation 410, the smart terminal controller 204 creates air pressure adjustment request data in response to user input information that is input by the input unit 207. For example, an instruction may be generated for changing the state (e.g., open and/or close) of the air pressure valve 110 in order to obtain the effect that the size of the vent hole 120 is enlarged or reduced by a predetermined degree according to the number of times of touching the "OPEN" or the "CLOSE" or the duration of the touching, or the number of times of inputs by buttons provided to correspond to the "OPEN" or the "CLOSE" or the duration of the inputs. It should be noted that the example of FIG. 7 according to various embodiments of the present disclosure is intended not to restrict the method that gives the effect that the size of the vent hole is enlarged or reduced, but to show the case to get the effect that the size of the vent hole 120 in the hearing aid device 100 is enlarged or reduced by regulating the air pressure valve 110. Consequentially, the data created for regulating the air pressure valve 110 as described above may be the data for adjusting the air pressure between the hearing aid device 100 and the tympanic membrane of the hearing aid device wearer.

The smart terminal controller 204 creates the air pressure adjustment request data for regulating the air pressure valve 110 in operation 410, and converts the air pressure adjustment request data to a format to be transmitted to the hearing aid device 100. The conversion of the data to the format to be transmitted to the hearing aid device 100 may mean to process the data according to a predetermined communication protocol. When the air pressure adjustment request data is created, the smart terminal controller 204 controls the modem 203 and the second wireless unit 202 to transmit the data to the hearing aid device 100. Accordingly, the data is transmitted from the smart terminal 200 to the hearing aid device 100 as shown in operation 414.

In operation 416, the hearing aid controller 103 opens and or closes the air pressure valve 110 based on the received air pressure adjustment request data in operation 416.

Afterward, the hearing aid controller 103 may receive the air pressure value from the air pressure sensor 107 after a predetermined time period has passed after the opening and closing of the air pressure valve 110. Next, the controller 103 may create a message indicating at least one of the amount of the change of the received air pressure, and a final air pressure value after the predetermined time, to thereby transmit the message to the smart terminal 200 by controlling the hearing aid wireless unit 106 in operation 416. At this time, the hearing aid controller 103 may transmit information indicating the degree to which the air pressure valve 110 is opened and/or closed, as well.

Accordingly, as shown in operation 418, the degree of the opening and closing of the air pressure valve 110 may be transmitted, and additionally, the changed value of the air pressure between the hearing aid device and the tympanic membrane of the hearing aid device wearer may be transmitted.

When the data transmitted in operation 418 is received through the second wireless unit 202 and the modem 203, the controller 204 of the smart terminal 200 controls the display unit 206 to display at least one of an indication of the degree of the opening and closing of the air pressure valve 110, an indication of the air pressure change and an indication of the final air pressure value in operation 420.

In some implementations, if the hearing aid device 100 does not provide the air pressure change information for the predetermined time but the degree of the opening and closing of the air pressure valve 110, the controller 204 may calculate an estimated value of the change of the air pressure between the hearing aid device 100 and the tympanic membrane of the hearing aid device wearer corresponding to the degree of the opening and closing of the air pressure valve 110 and display the estimated air pressure value on the display unit 206. If the estimated air pressure value is stored in the smart terminal memory 205, the smart terminal controller 204 may retrieve and display the data stored in the smart terminal memory 205.

Figure 6:
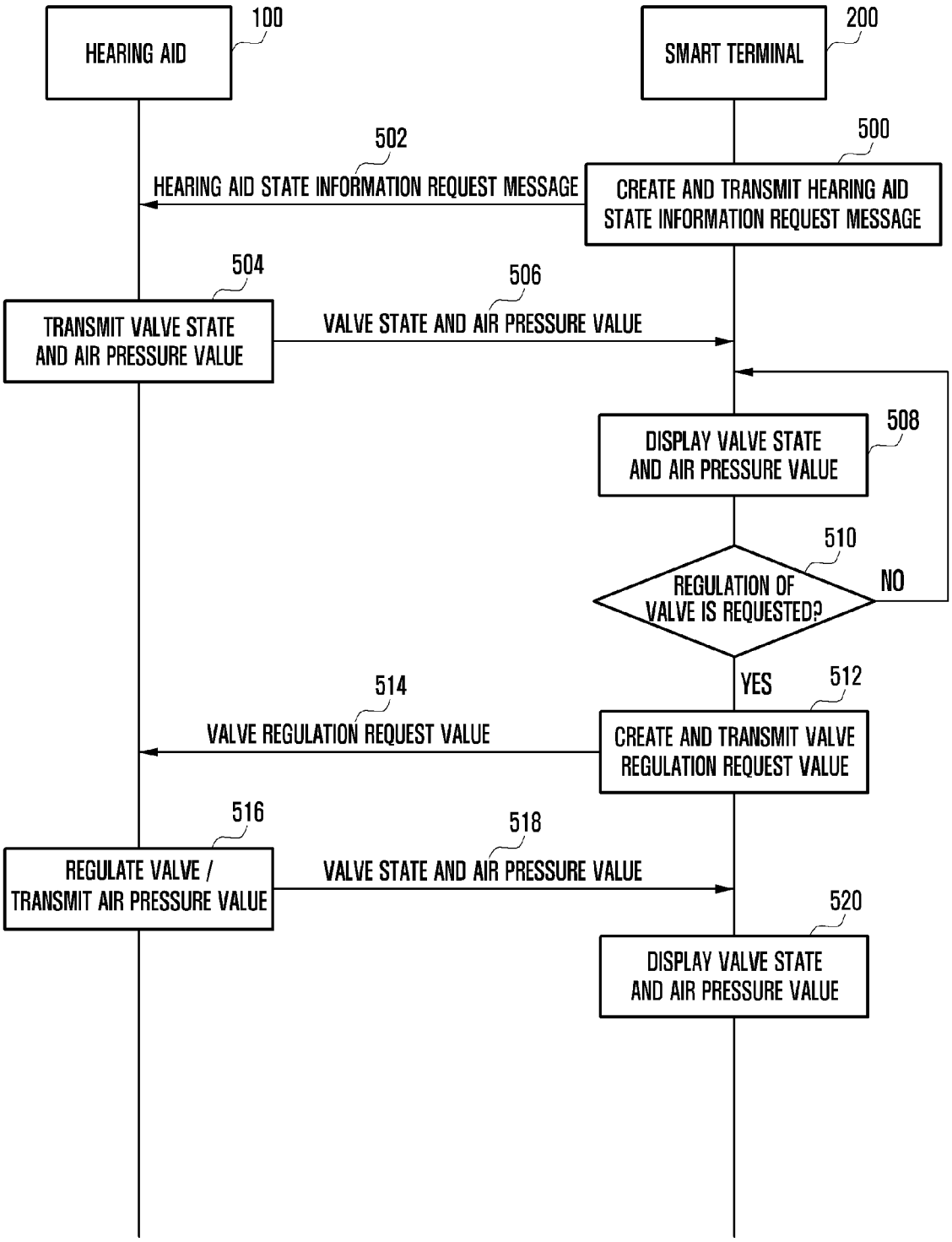
FIG. 6 is a flowchart of a process, according to aspects of the disclosure.

FIG. 6 is a flowchart of a process in accordance with aspects of the disclosure.

FIG. 6 will be described on the assumption that a specific application program for applying the present disclosure is installed in the smart terminal 200. For example, the smart terminal 200 stores an application program for regulating the air pressure valve 100 of the hearing aid device 100. The smart terminal 200 may regulate the air pressure valve 110 of the hearing aid device 100 through the application program to adjust the air pressure between the hearing aid device 100 and the tympanic membrane of the hearing aid device wearer. In addition, it is assumed that the application program installed in the smart terminal 200 may request the value of the air pressure between the hearing aid device 100 and the tympanic membrane of the hearing aid device wearer. Further, it is assumed that the user of the smart terminal 200 is an ear-wearable device wearer, i.e., a hearing-impaired patient. The signal flowchart of FIG. 6 shows that the wearer of the hearing aid device 100 verifies the state of the hearing aid device 100 and controls the hearing aid device 100 by using the smart terminal 200 when he or she feels a discomfort (e.g., due to echo or the closure effect). If the hearing aid device wearer feels the closure effect or echo, he or she may execute the application program installed in the smart terminal 200, i.e., the application program for controlling the hearing aid device 100 according to various aspects of the present disclosure. Afterward, the hearing aid device wearer may operate the application program installed in the smart terminal 200 to thereby request state information including the air pressure between the hearing aid device 100 and the tympanic membrane of the hearing aid device wearer.

As described above, in operation 500, the user of the smart terminal 200 executes the application program according to various aspects of the present disclosure and requests the state information of the hearing aid device through the input unit 207. When the state information of the hearing aid device is requested through the input unit 207, the smart terminal controller 204 creates an ear-wearable device state information request message in operation 500 and provides it to the modem 203. Then, the modem 203 encodes and modulates the hearing aid device state information request message according to the control of the smart terminal controller 204, and provides the same to the second wireless unit 202. Accordingly, the second wireless unit 202 transforms the data encoded and modulated under the control of the smart terminal controller 204 into high-frequency band and transmits the same to the hearing aid device 100. Operation 502 shows the hearing aid device state information request message transmitted through the above process.

When the hearing aid device state information request message transmitted in operation 502 is received, the hearing aid controller 103 transforms the state of the air pressure valve 110 and the value of the air pressure between the hearing aid device 100 and the tympanic membrane of the hearing aid device wearer into the data to be transmitted in operation 504. Here, the state of the air pressure valve 110 may be information on the size of the vent hole 120 or the value of the degree of the opening and closing of the air pressure valve 110. Further, the air pressure value may be the value of the air pressure between the hearing aid device 100 and the tympanic membrane of the hearing aid device wearer, which obtained from the air pressure sensor 107. Furthermore, the hearing aid device 100 may provide at least one of the values.

The hearing aid controller 103 generates data indicating at least one of the air pressure level and the state of the air pressure valve 110 and controls the hearing aid wireless unit 106 to transmit the data to the smart terminal 200. Operation 506 shows that the hearing aid device 100 transmits the data created in operation 504 to the smart terminal 200.

When the data is received in operation 506, the smart terminal 200 displays the state of the valve and air pressure value on the display unit 206 in operation 508. This may be the same as shown in FIG. 7. In the displaying of FIG. 7, if the air pressure valve 110 is not required to be regulated, the smart terminal 200 may display nothing or a message of "Operation is normal" on the guide message display area of reference numeral 613 in FIG. 7. On the contrary, if: (1) the difference between the air pressure received from the hearing aid device 100 and the predetermined air pressure is greater than a reference value and/or (2) the air pressure received from the hearing aid device 100 falls within a predetermined range, and/or (3) the air pressure value is determined to have exited a first predetermined range and entered into a second predetermined range, the smart terminal 200 may display a message for informing of that on the guide message display area of reference numeral 613 in FIG. 7.

When the air pressure changes greatly or the hearing aid device wearer experiences a discomfort, the hearing aid device wearer may adjust the size of the vent hole 120 by regulating the air pressure valve 110. In operation 510, it is verified whether an input signal for adjusting the size of the vent hole 120 by the hearing aid device wearer by regulating the air pressure valve 110 is received through the input unit 207.

When the valve is required to be regulated as a result of the verification in operation 510, the smart terminal controller 204 creates air pressure valve regulation request data received through the input unit 207 and controls the modem 203 and the second wireless unit 202 to transmit the data to the hearing aid device 100 in operation 512.

Operation 514 shows that the air pressure valve regulation request data created in operation 512 is transmitted to the hearing aid device 100. When the valve regulation request data is received in operation 514, the hearing aid device 100 regulates the air pressure valve 100 in response to the received valve regulation request data in operation 516. Accordingly, the air pressure between the hearing aid device 100 and the tympanic membrane of the hearing aid device wearer may be adjusted.

Next, the hearing aid controller 103 may receive the air pressure value from the air pressure sensor 107 for a predetermined time after regulating the air pressure valve 110 and create a message for the amount of the change of the received air pressure value or the final air pressure value after the predetermined time in operation 516. Then, the hearing aid controller 103 may control the hearing aid wireless unit 106 to transmit the message to the smart terminal 200. At this time, the hearing aid controller 103 may control to transmit the information on the degree of the opening and closing of the air pressure valve 110.

Accordingly, the degree of the opening and closing of the air pressure valve 110 and the changed air pressure value may be transmitted as shown in operation 518. Operation 518 shows that the created air pressure value and the state information of the air pressure valve 110 are transmitted from the hearing aid device 100 to the smart terminal 200.

When the data transmitted in operation 518 is received through the second wireless unit 202 and the modem 203, the controller 200 of the smart terminal 200 controls to display the received degree of the opening and closing of the air pressure valve 110 and the air pressure change information or the final changed air pressure value on the display unit 206 in operation 520.

At this time, if the hearing aid device 100 provides not the air pressure change information for the predetermined time but the information on the degree of the opening and closing of the air pressure valve 110, the controller 204 may control to calculate an estimated value of the change of the air pressure between the hearing aid device 100 and the tympanic membrane of the hearing aid device wearer corresponding to the degree of the opening and closing of the air pressure valve 110 and display the estimated air pressure value on the display unit 206. If the estimated air pressure value is stored in the smart terminal memory 205, the smart terminal controller 204 may control to retrieve and display the data stored in the smart terminal memory 205.

Figure 8:
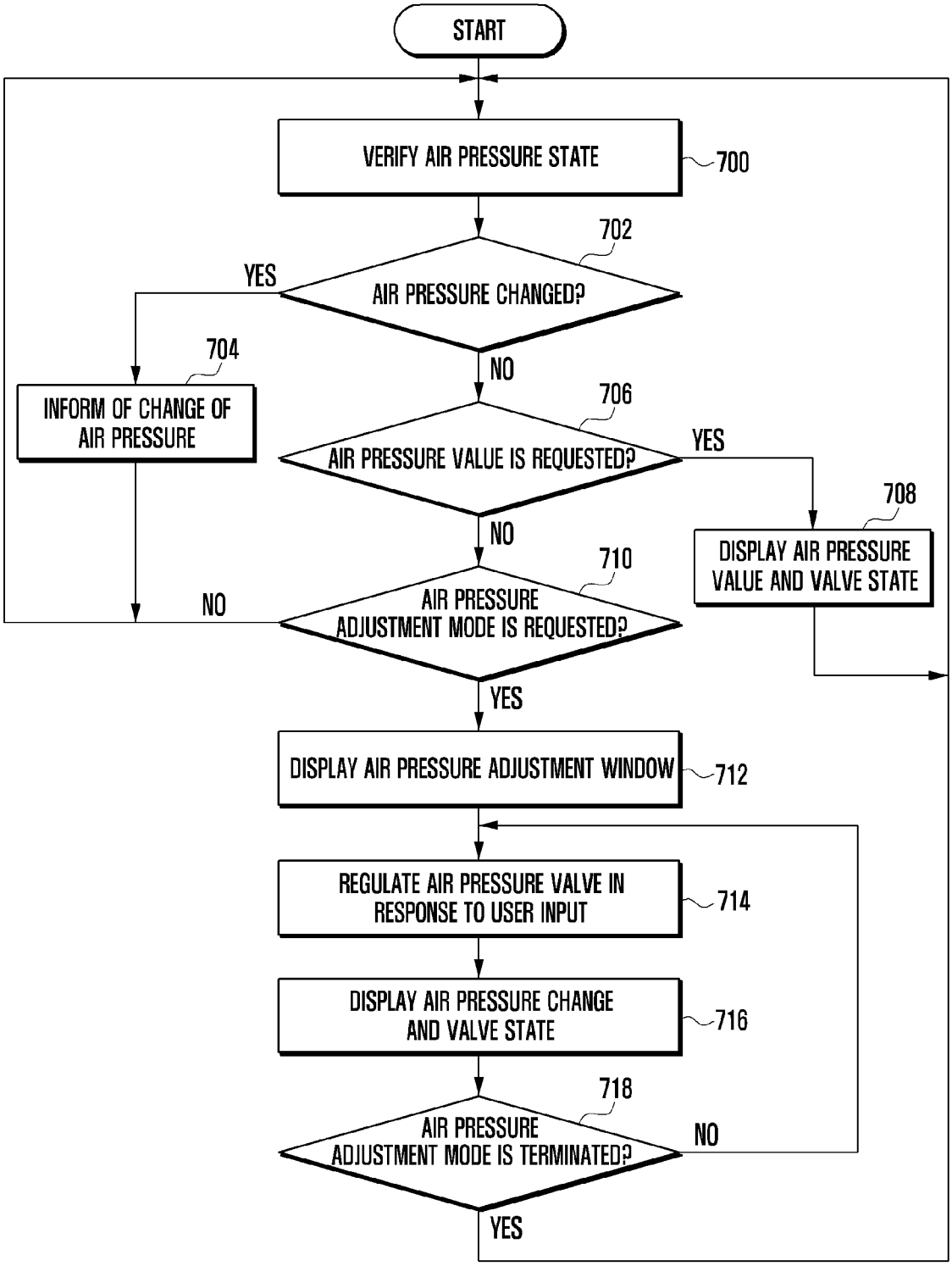
FIG. 8 is a flowchart of a process, according to aspects of the disclosure.

FIG. 8 is a flowchart of a process in accordance with aspects of the disclosure.

The hearing aid device that can be applied to FIG. 8 will be described prior to the detailed description of FIG. 8. The hearing aid device used in FIG. 8 may include a user input unit as well as the elements of FIG. 2. Accordingly, the user may adjust the air pressure between the hearing aid device 100 and the tympanic membrane of the hearing aid device wearer through the user input unit.

With the user input unit, the hearing aid device 100 may further include a display unit for informing the user of the air pressure between the hearing aid device 100 and the tympanic membrane of the hearing aid device wearer or the degree of the opening and closing of the air pressure valve 110 or providing a convenience for the user's input. The display unit may be implemented by display devices such as LCDs, LEDs, or the like. Further, the display unit may display the state of the air pressure between the hearing aid device and the tympanic membrane, the degree of the opening and closing of the oil pressure type micro-valve of the hearing aid device, and a content for providing the convenience for the user's input in the form of a text or/and a number or/and a graph or/and an emoticon. Furthermore, the display unit may include a vibration motor or a fragrance generator for informing the user of an abnormal state.

In the above case, the user input unit or/and the display unit may be provided on the hearing aid device, connected with the hearing aid device by cables, or communicate with the hearing aid device by wireless communication means such as a remote controller.

FIG. 8 will be described on the assumption that the hearing aid device includes the user input unit and the display unit. In some implementations, the input unit may include a wireless/wired remote controller for controlling the hearing aid device and the display unit.

In operation, the hearing aid controller 103 receives the value of the air pressure between the hearing aid device 100 and the tympanic membrane of the hearing aid device wearer, which is measured by the air pressure sensor 107 continuously or in a predetermined cycle, and verifies the state of the air pressure in operation 700. The verification of the air pressure may be aimed at receiving the air pressure between the hearing aid device 100 and the tympanic membrane of the hearing aid device wearer from the air pressure sensor 107 and verifying whether the received air pressure value is less than or equal to the predetermined air pressure value or in the predetermined range of air pressure, as set forth above in FIGS. 4 and 5. The predetermined cycle or time interval may be configured by the user or the manufacturer of the product.

The hearing aid controller 103 determines whether the received air pressure value is different from the predetermined air pressure value or exceeds the predetermined range of air pressure in operation 702.

As a result of the determination in operation 702, when the air pressure received from the air pressure sensor 107 is different from the predetermined air pressure value or exceeds the predetermined range of the air pressure, it is determined that the air pressure has been changed, and then the hearing aid controller 103 proceeds to operation 704. Otherwise, the hearing aid controller 103 proceeds to operation 706.

In operation 704, the hearing aid controller 103 informs of the change of the air pressure through the display unit. As described above, the change of the air pressure may be informed of in the form of a text or/and a number or/and a graph or/and an emoticon. Additionally, the user may be informed of the change of the air pressure by providing a vibration or/and a fragrance or a specific alert sound or/and voice. At this time, the display pattern may be the same as or similar to that set forth in FIG. 7. That is, the air pressure of the external auditory meatus may be displayed together with the atmospheric pressure information, and a text for indicating how to deal with the current state may be displayed. Further, the air pressure adjustment window 614 may be displayed on the display unit. Accordingly, after operation 704, the sequence may proceed to operation 700, operation 710, or operation 712.

In operation 706 after operation 702, the hearing aid controller 103 verifies whether the air pressure value request signal is received from the user through the input unit. If the air pressure value is requested as a result of the verification in operation 706, the hearing aid controller 103 proceeds to operation 708. On the contrary, if the air pressure value is not requested, the hearing aid controller 103 proceeds to operation 710. In addition, the process may skip operation 702 and operation 706, and directly proceed to operation 710.

In operation 708, the hearing aid controller 103 controls the display unit to display the air pressure value measured by the air pressure sensor 107. At this time, only the air pressure value may be displayed, or the change of the air pressure may be displayed. Further, the air pressure value or/and the change of the air pressure may be displayed in the form of a text or/and a number or/and a graph or/and an emoticon.

In operation 710, the hearing aid controller 103 verifies whether an air pressure adjustment mode is requested by the input unit. This may refer to checking whether the air pressure valve 110 is requested to be regulated. If the air pressure adjustment is requested as a result of the verification in operation 710, the hearing aid controller 103 proceeds to output 712. Otherwise, the hearing aid controller 103 proceeds to operation 700.

Proceeding to operation 712, the hearing aid controller 103 displays the air pressure adjustment window 614 that is the same as or similar to that of FIG. 7 on the display unit and then proceeds to operation 714. In operation 714, the hearing aid controller 103 receives a user input, such as a key input, a touch input, a hovering input (the input of the wearer's hand gesture without touching the hearing aid device), a voice input, a motion input (the change of hearing aid device movement input by movement of the hearing aid device wearer's head), a brainwave input, or the like, which are input by the user through the input unit, and regulates the air pressure valve 110 in response to the received input.

Afterward, the hearing aid controller 103 receives the air pressure value from the air pressure sensor 107 for a predetermined time after regulating the air pressure valve 110 in operation 716, and controls to display the received amount of the change of the air pressure or the final changed air pressure value after the predetermined time on the display unit. At this time, the hearing aid controller 103 may control to display the information on the degree of the opening and closing (or the degree of adjustment) of the air pressure valve 100 on the display as well.

Next, the hearing aid controller 103 verifies whether the air pressure adjustment mode is requested to be terminated in operation 718. If the air pressure adjustment mode is requested to be terminated as a result of the verification in operation 718, the hearing aid controller 103 proceeds to operation 700. On the contrary, if the air pressure adjustment mode is not requested to be terminated, the hearing aid controller 103 proceeds to operation 714 to continue to regulate the air pressure valve 110 in response to the user input. Alternatively, the termination of the air pressure adjustment mode may be automatically requested after a predetermined time.

Alternatively, although operation 714 is performed after operation 718 in FIG. 8, operation 712 may follow operation 718.

As described above, the user's convenience may be enhanced by using the hearing aid device having the input unit and the display unit or the device having the input unit and the display unit in the form of a wireless or wired remote controller for controlling the hearing aid device. That is, the air pressure valve provided on the hearing aid device may be regulated by using only the device that is paired with the hearing aid device without using the smart terminal or other external apparatus, to thereby adjust the air pressure between the hearing aid device 100 and the tympanic membrane according to a user's desire.

The hearing aid device 100 having the display unit was described above. If the hearing aid device 100 does not have the display unit, a voice, a vibration, LED-blinking, or an alert sound may be provided instead of the display unit. Alternatively, in the case of the hearing aid device 100 not having the display unit, operation 706 and operation 708 may be omitted in FIG. 8. In addition, in the case of the hearing aid device 100 not having the display unit, operation 712 is not necessary. In this case, operation 716 may be executed by the user input in operation 714, and the displaying of operation 716 may be omitted.

The above-described aspects of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

It should further be noted that the FIGS. 1-8 are provided as examples only. At least some of the operations discussed with respect to those figures can be performed in a different order, performed concurrently, or altogether omitted. Although, the examples throughout the disclosure are provided in the in the context of an ear-wearable device, it is to be understood that the concepts revealed in those examples can be applied to headphones, headsets, and/or any other suitable type of ear-wearable device. Although aspects of the disclosure have been described in detail hereinabove, it should be understood that many variations and modifications of the basic inventive concept described herein will still fall within the spirit and scope of the disclosure as defined in the appended claims.

What is claimed is:

1. A method comprising:

transmitting, to an ear-wearable device via a wireless channel, measurement request signal of an air pressure in a space between the ear-wearable device and a tympanic membrane of a wearer of the ear-wearable device, when the measurement request of the air pressure is received from an input unit;

receiving a measurement value of the air pressure from the an ear-wearable device via the wireless channel;

displaying, on a display unit, the measurement value;

receiving a request signal for adjusting the air pressure from the input unit;

generating a regulation signal for adjusting a valve within the ear-wearable device based on the request signal; and transmitting the regulation signal to the ear-wearable device via the wireless channel.

2. The method of claim 1, further comprising:

comparing the measurement value with a predetermined air pressure value or a predetermined range of the air pressure; and providing at least one of a guide message, a guide image, or a guide voice, if the measured air pressure is different from the predetermined air pressure value or exceeds the predetermined range of the air pressure.

3. The method of claim 1, further comprising:

receiving information indicating a state of the valve in response to the regulation signal transmitted via the wireless channel; and displaying, on the display unit, the state of the valve.

4. The method of claim 1, further comprising:

receiving current atmospheric pressure information from a sensor unit; and displaying, on the display unit, the atmospheric pressure.

5. The method of claim 1, further comprising:

receiving, from the ear-wearable device via the wireless channel, information indicating a state of a valve of the an ear-wearable device; and displaying, on the display unit, an indication of the state of the valve of the an ear-wearable device.

6. The method of claim 5, wherein the indication of the state of the valve indicates a degree to which a vent hole in the an ear-wearable device is opened or closed.

7. An ear-wearable device comprising:

an air pressure sensor configured to measure air pressure in a space between the ear-wearable device and a tympanic membrane of a wearer of the an ear-wearable device;

an air pressure valve configured to adjust the air pressure in the space between the ear-wearable device and the tympanic membrane of the wearer of the ear-wearable device;

a wireless unit configured to communicate with an electronic apparatus through a wireless channel; and a controller configured to, when a regulation signal is received through the wireless unit, open or close the air pressure valve in response to the regulation signal and when a measurement request signal is received through the wireless unit, control the wireless unit to transmit the measured air pressure via the wireless channel.

8. The ear-wearable device of claim 7, further comprising an input unit for inputting the regulation signal.

9. The ear-wearable device of claim 7, wherein the air pressure valve is arranged to open or close a vent hole of the ear-wearable device.

10. The ear-wearable device of claim 7, further comprising a memory configured to store an air pressure threshold, wherein the controller is further configured to repeatedly measure the air pressure and output an alarm when the air pressure exceeds the air pressure threshold.

11. An electronic device comprising a processor configured to:

transmit, to an ear-wearable device via a wireless channel, a request for a measurement of an air pressure in a space between an ear-wearable device and a tympanic membrane of a wearer of the ear-wearable device, when the measurement request of the air pressure is received from an input unit;

receive a measurement value of the air pressure from the ear-wearable device via the wireless channel;

output the measurement value to display on a display unit;

receive a request signal for adjusting the air pressure from the input unit;

generate a regulation signal for adjusting a valve within the ear-wearable device based on the request signal; and transmit the regulation signal to the ear-wearable device via the wireless channel.

12. The electronic device of claim 11, wherein the processor is further configured to:

compare the measurement value with a predetermined air pressure value or a predetermined range of the air pressure; and output an alarm to display on the display unit, if the measured air pressure is different from the predetermined air pressure value or exceeds the predetermined range of the air pressure.

13. The electronic device of claim 12, wherein the alarm includes at least one of outputting a text, a number, a sign, an emoticon, and a graph.

* * * * *